US010495081B2

(12) United States Patent
Ha et al.

(10) Patent No.: US 10,495,081 B2
(45) Date of Patent: Dec. 3, 2019

(54) LINEAR COMPRESSOR

(71) Applicant: LG ELECTRONICS INC., Seoul (KR)

(72) Inventors: Seongho Ha, Seoul (KR); Hyosang Yu, Seoul (KR); Jaeyoun Lim, Seoul (KR); Kichul Choi, Seoul (KR); Jungwan Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 147 days.

(21) Appl. No.: 15/585,316

(22) Filed: May 3, 2017

(65) Prior Publication Data

US 2017/0321676 A1 Nov. 9, 2017

(30) Foreign Application Priority Data

May 3, 2016 (KR) ..... 10-2016-0054908

(51) Int. Cl.
*F04B 35/04* (2006.01)
*F04B 39/00* (2006.01)
(Continued)

(52) U.S. Cl.
CPC ..... *F04B 39/0061* (2013.01); *F04B 35/04* (2013.01); *F04B 35/045* (2013.01);
(Continued)

(58) Field of Classification Search
CPC . F04B 35/045; F04B 39/0061; F04B 39/0044
See application file for complete search history.

(56) References Cited

U.S. PATENT DOCUMENTS 5,993,178 A * 11/1999 Park ..... F04B 35/045 417/416
7,306,438 B2 * 12/2007 Kang ..... F04B 35/045 181/229
(Continued)

FOREIGN PATENT DOCUMENTS

CN 1769683 5/2006
CN 104251190 12/2014
(Continued)

OTHER PUBLICATIONS

European Search Report dated Sep. 20, 2017 issued in Application No. 17169046.4.
(Continued)

*Primary Examiner* — Charles G Freay
*Assistant Examiner* — Thomas Fink
(74) *Attorney, Agent, or Firm* — Ked & Associates LLP

(57) ABSTRACT

A linear compressor is provided that may include a casing, a frame accommodated in the casing, a cylinder that passes through a center of the frame, supported by the frame, and defining a compression space for a refrigerant, a piston inserted into the cylinder to reciprocate in an axial direction of the cylinder and having a first end that compresses the refrigerant supplied to the compression space, a suction muffler which is coupled to a second end of the piston and through which the refrigerant supplied to the compression space may flow, a spring that allows a resonant motion of the piston, a back cover including a cover body that defines a refrigerant opening at a central portion, such that a refrigerant passes therethrough, the back cover supporting the spring, and an inflow guide which is fixed to the cover body and guides the refrigerant passing through the refrigerant opening towards an inside of the suction muffler. At least a portion of the inflow guide may be inserted into the suction
(Continued)

muffler, and a central axis thereof may be aligned with a central axis of the refrigerant opening.

16 Claims, 9 Drawing Sheets

(51) Int. Cl.
*F04B 37/18* (2006.01)
*F04B 39/12* (2006.01)

(52) U.S. Cl.
CPC ..... *F04B 37/18* (2013.01); *F04B 39/0016* (2013.01); *F04B 39/0044* (2013.01); *F04B 39/121* (2013.01)

(56) References Cited

U.S. PATENT DOCUMENTS 9,677,553 B2* 6/2017 Jeong ..... F04B 35/045
2002/0176790 A1* 11/2002 Akazawa ..... F04B 35/045 417/417
2003/0099558 A1* 5/2003 Chang ..... F04B 35/045 417/417
2006/0093498 A1 5/2006 Kim
2009/0252625 A1* 10/2009 Lee ..... F04B 35/045 417/437
2010/0260629 A1* 10/2010 Kang ..... F04B 35/045 417/417
2010/0290936 A1* 11/2010 Kang ..... F04B 35/045 417/417
2010/0316513 A1* 12/2010 Lee ..... F04B 35/045 417/417
2011/0194957 A1* 8/2011 Kang ..... F04B 35/045 417/415
2013/0115116 A1* 5/2013 Ki ..... F04B 35/045 417/321
2015/0004014 A1* 1/2015 Kim ..... F04B 39/0027 417/312
2015/0004017 A1* 1/2015 Kang ..... F04B 39/0044 417/363
2015/0004021 A1* 1/2015 Kang ..... F04B 35/045 417/410.1
2015/0004027 A1* 1/2015 Kang ..... F04B 35/045 417/417
2015/0004028 A1* 1/2015 Kang ..... F04B 35/04 417/417
2015/0078925 A1* 3/2015 Choi ..... F04B 35/045 417/228

FOREIGN PATENT DOCUMENTS

CN 105275776 1/2016
CN 105298795 2/2016
CN 107304759 10/2017
EP 2 975 267 1/2016
EP 2 977 612 1/2016
KR 10-2014-0049403 4/2014
WO WO 2007/046610 4/2007

OTHER PUBLICATIONS

Chinese Office Action dated Aug. 1, 2018 with English Translation.

* cited by examiner

LINEAR COMPRESSOR

CROSS-REFERENCE TO RELATED APPLICATION(S)

The present application claims the benefits of priority to Korean Patent Application No. 10-2016-0054908, filed in Korea on May 3, 2016, which is herein incorporated by reference in its Entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged is defined between a roller that eccentrically rotates and a cylinder to allow the roller to eccentrically rotate along an inner wall of the cylinder, thereby compressing a refrigerant and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

Korean Patent Publication No. 10-2014-0049403 (hereinafter, referred to as "prior art document"), which was published on Apr. 25, 2014 and is hereby incorporated by reference, discloses a linear compressor. The linear compressor of the prior art document compresses a refrigerant while a piston reciprocates within a cylinder. Oil stored in a shell is supplied to the cylinder to perform a lubrication action between the piston and the cylinder.

When the linear compressor is provided in a refrigerator the linear compressor may be disposed in a machine room which is provided at a rear lower side of the refrigerator. In recent years, a major concern of a customer is of increasing an inner storage space of the refrigerator. To increase the inner storage space of the refrigerator it may be necessary to reduce a volume of the machine room. Also, to reduce the volume of the machine room, it may be important to reduce a size of the linear compressor.

However, as the linear compressor disclosed in the prior art document has a relatively large volume, the linear compressor is not adequate for the refrigerator for increasing the inner storage space thereof. To reduce the size of the linear compressor, it may be necessary to reduce a size of a main part or component of the linear compressor. In this case, the linear compressor may be deteriorated in performance.

To compensate for the deteriorated performance of the linear compressor, it may be considered to increase a drive frequency of the compressor. However, the more the drive frequency of the compressor is increased, the more a friction force due to oil circulating into the compressor increases, deteriorating performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
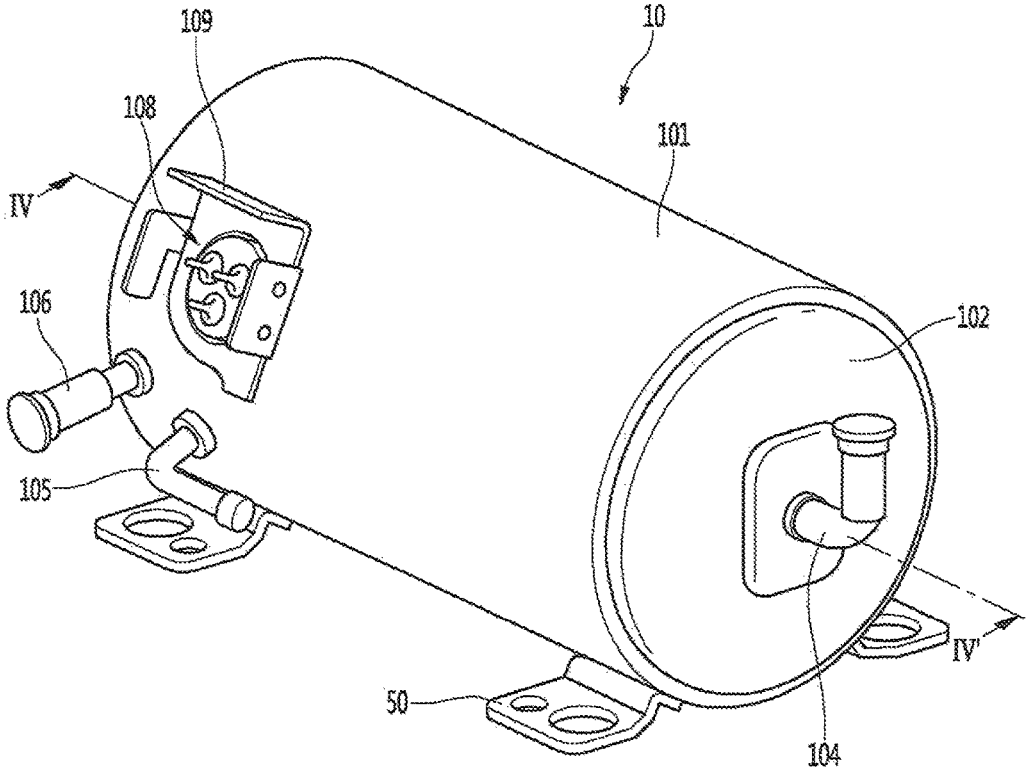
FIG. 1 is a perspective view illustrating an outer appearance of a linear compressor according to an embodiment.

Hereinafter, embodiments will be described in detail with reference to the accompanying drawings. Where possible, like reference numerals have been used to indicate like elements, and repetitive disclosure has been omitted.

Figure 2:
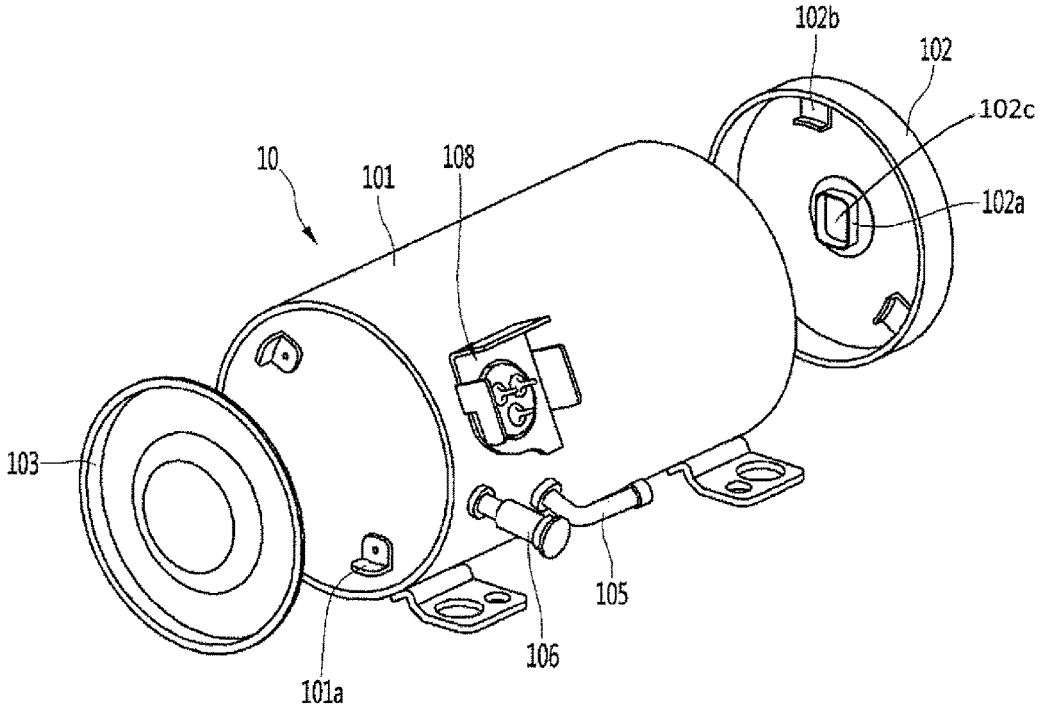
FIG. 2 is an exploded perspective view of a shell and a shell cover of the linear compressor according to an embodiment.

FIG. 1 is a perspective view illustrating en outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101. Therefore, the shell 101 and the shell covers 102 and 103 may be collectively referred to as a casing.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed, or provided in the machine room base of the refrigerator, a machine room may be reduced in height.

A terminal 108 may be installed or provided on an outer surface of the shell 101. The terminal 108 may transmit external power to a motor (see reference, numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 182 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10 and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in the axial direction. It is apparent that the suction pipe 104 may be coupled to the shell 101 at a position adjacent to the first shell cover 102.

At least a portion of the suction pipe 104 may be bent upward in a state of being coupled to the first shell cover 102. In this case, when the linear compressor 10 is applied to a refrigerant, a process of coupling pipes may be facilitated in a machine room of the refrigerant.

The discharge pipe 105 may be coupled to the shell 101. The refrigerant suctioned through the suction pipe 104 may be compressed while flowing in the axial direction of the shell 101. Also, the compressed refrigerant may be discharged through the discharge pipe 105. The discharge pipe 105 may be disposed at a position which is adjacent to the second shell cover 103 rather than the first shell cover 102.

Figure 3:
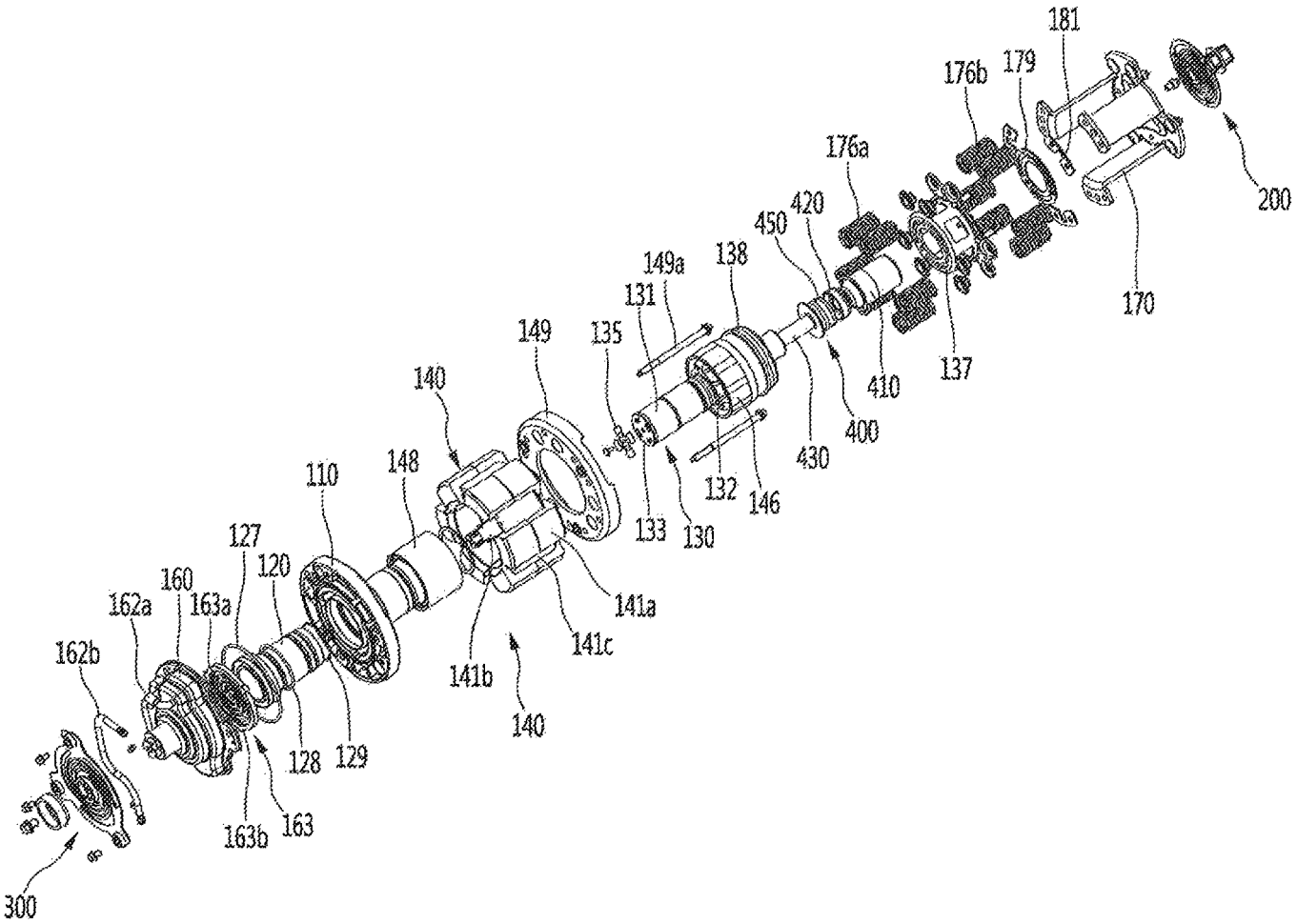
FIG. 3 is an exploded perspective view illustrating internal parts or components of the linear compressor according to an embodiment.
Figure 4:
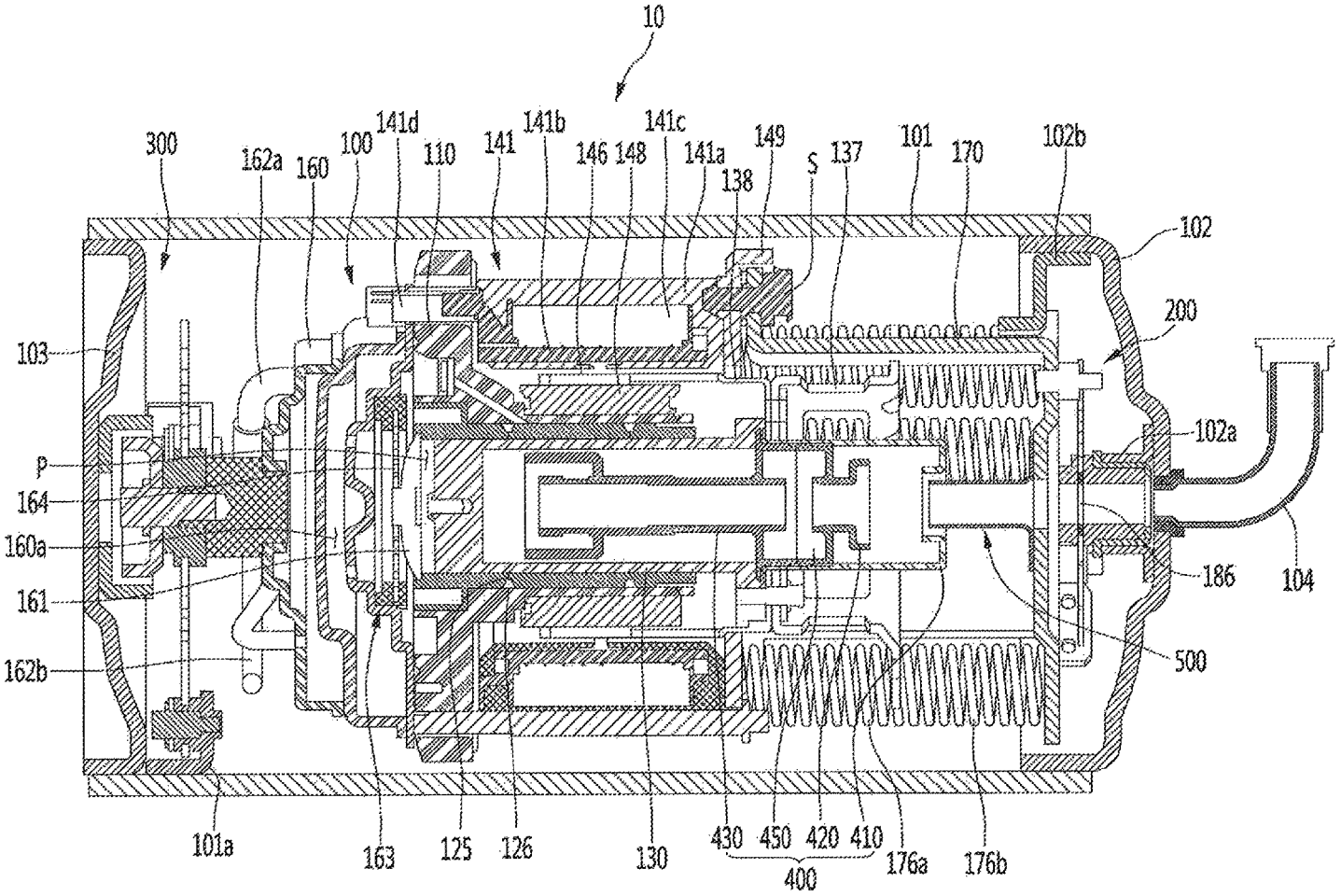
FIG. 4 is a cross-sectional view, taken along line IV-IV' of FIGS. 1.

FIG. 3 is an exploded perspective view illustrating internal parts or components of the linear compressor according to an embodiment. FIG. 4 is a cross-sectional view, taken along line IV-IV' of FIG. 1.

Referring to FIGS. 3 and 4, the linear compressor 10 according to an embodiment may include a compressor body 100 and a plurality of support devices or supports that support the compressor body 100 to one or more of the shell 101 and the shell covers 102 and 103.

The compressor body 100 may include a cylinder 120 provided in the shell 101, a piston 130 that linearly reciprocates within the cylinder 120, and a motor 140 that applies, a drive force to the piston 130. The motor 140 may include a linear motor. Therefore, when the motor 140 is driven, the piston 130 may reciprocate in the axial direction of the shell 101.

The compressor body 100 may further include a suction muffler 400. In detail, the suction muffler 400 may be coupled to the piston 130 to reduce noise generated from the refrigerant suctioned through the suction pipe 104. The refrigerant suctioned through the suction pipe 104 may flow into the piston 130 via the suction muffler 400. For example, while the refrigerant passes through the suction muffler 400, a flow noise of the refrigerant may be reduced.

The suction muffler 400 may include a plurality of mufflers 410, 420, and 430. The plurality of mufflers 410, 420, and 430 may include a first muffler 410, a second muffler 420, and a third muffler 430, which may be coupled to each other.

The third muffler 430 may be disposed or provided within the piston 130, and the second muffler 420 may be coupled to a rear portion of the third muffler 430. Also, the first muffler 410 may accommodate the second muffler 420 therein and extend to a rear side of the third muffler 430. In view of a flow direction of the refrigerant, the refrigerant suctioned through the suction pipe 104 may successively pass through the first muffler 410, the second muffler 420, and the third muffler 430 in this process, the flow noise of the refrigerant may be reduced.

The suction muffler 400 may include a muffler filter 450. The muffler filter 450 may be disposed or provided on or at an interface on or at which the second muffler 420 and the third muffler 430 are coupled to each other. For example, the muffler filter 450 may have a circular shape, and an outer circumferential portion of the muffler filter 450 may be supported between the second and third mufflers 420 and 430.

The "axial direction" defined herein may be a central axis direction of the shell 101 and may be understood as a direction (horizontal direction of FIG. 4) in which, the piston 130 reciprocates. Also, in the "axial direction" a direction from the suction pipe 104 toward a compression space P, that is, a direction in which the refrigerant flows may be defined as a "frontward direction", and a direction opposite to the frontward direction may be defined as a "rearward direction". On the other hand, the "radial direction" may be understood as a direction which is perpendicular to the radial direction of the shell 101 or the direction (vertical direction of FIG. 4) in which the piston 130 reciprocates. The "axis of the compressor body" means the central line in the axial direction or central longitudinal axis of the piston 130 or the central axis or central longitudinal axis of the shell 101.

The piston 130 may include a piston body 131 having an approximately cylindrical shape and a piston flange 132 that extends from the piston body 131 in the radial direction. The piston body 131 may reciprocate inside of the cylinder 120, and the piston flange 132 may reciprocate outside of the cylinder 120.

The cylinder 120 may accommodate at least a portion of the third muffler 430 and at least a portion of the piston body 131. The cylinder 120 has the compression space P in which the refrigerant is compressed by the piston 130. A suction hole 133, through which the refrigerant may be introduced into the compression space P, may be defined in a front portion of the piston body 131, and a suction valve 135 that selectively opens the suction hole 133 may be disposed or provided on or at a front side of the suction hole 133. A coupling hole to which a predetermined coupling member may be coupled may be defined in an approximately central portion of the suction valve 135.

A discharge cover assembly 160 and a discharge valve assembly 161 and 163 may be provided in or at a front side of the compression space P. The discharge cover assembly 160 may define a discharge space 160*a* for a refrigerant discharged from the compression space P. The discharge valve assembly 161 and 163 may be coupled to the discharge cover assembly 160 to selectively discharge the refrigerant compressed in the compression space P. The discharge space 160*a* may include a plurality of space parts or spaces which may be that are partitioned by inner walls of the discharge cover assembly 400. The plurality of space parts may be disposed or provided in the frontward and rearward direction to communicate with each other.

The discharge valve assembly 161 and 163 may include a discharge valve 161 and a spring assembly 163. The discharge valve 161 may be opened when a pressure of the compression space P is above a discharge pressure to introduce the refrigerant into the discharge space 401 of the discharge cover assembly 400. The spring assembly 163 may be disposed or provided between the discharge valve 161 and the discharge cover 160 to provide an elastic force in the axial direction.

The spring assembly 163 may include a valve spring 163*a* and a spring support part or support 163*b* that supports the valve spring 163*a* to the discharge cover 160. For example, the valve spring 163*a* may include a plate spring. The spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space P may be maintained in a sealed state. When the discharge valve 161 is spaced apart from the front surface of the cylinder 120, the compression space P may be opened to discharge the refrigerant compressed in the compression space P.

The compression space P may be a space defined between the suction valve 135 and the discharge valve 161. The suction valve 135 may be disposed or provided on or at one or a first side of the compression space P, and the discharge valve 161 may be disposed or provided on or at the other or a second side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. The refrigerant may be discharged from the compression space P into the discharge space of the discharge cover 160. When the discharge of the refrigerant is completed, the discharge valve 161 may be closed by a restoring force of the valve spring 163*a*.

The compressor body 100 may further include a cover pipe 162*a*. The cover pipe 162*a* may be coupled to the discharge cover assembly 160 to discharge the refrigerant flowing through the discharge space 160*a* of the discharge cover assembly 160. For example, the cover pipe 162*a* may be made of a metal material.

The compressor body 100 may further include a loop pipe 162*b*. The loop pipe 162*b* may be coupled to the cover pipe 162*a* to move the refrigerant flowing through the cover pipe 162*a* to the discharge pipe 105. The loop pipe 162*b* may have one or a first end coupled to the cover pipe 162*a* and the other or a second end coupled to the discharge pipe 105.

The loop pipe 162*b* may include a flexible material. The loop pipe 162*b* may roundly extend from the cover pipe 162*a* along an inner circumferential surface of the shell 101 and be coupled to the discharge pipe 105. For example, the loop pipe 162*b* may have a wound shape.

The compressor body 100 may further include a frame 110. The frame 110 may be configured to fix the cylinder 120. For example, the cylinder 120 may be press-fitted into the frame 110.

The frame 110 may be disposed or provided to surround the cylinder 120. That is, the cylinder 120 may be disposed or provided to be accommodated into the frame 110. Also, the discharge cover 160 may be coupled to a front surface of the frame 110 using a coupling member.

The frame 110 may define a gas hole 114 for a flow of the refrigerant discharged by the discharge valve 161. The cylinder 120 may define a gas inflow part or inflow 126 through which the gas refrigerant flowing through the gas hole 114 may be introduced.

The gas inflow part 126 may be recessed inward from an outer circumferential surface of the cylinder 121 in the radial direction. The gas inflow part 126 may have a circular shape along the outer circumferential surface of the cylinder 120 with respect to the central axis in the axial direction.

The cylinder 120 may further include a cylinder nozzle 125 that extends inward from the gas inflow part 126 in the radial direction. The cylinder nozzle 125 may extend up to the inner circumferential surface of the cylinder 120.

The refrigerant passing through the cylinder nozzle 125 may be introduced into a space between the inner circumferential surface of the cylinder 120 and the outer circumferential surface of the piston body 131. The gas refrigerant flowing to the outer circumferential surface of the piston body 131 through the cylinder nozzle 125 may provide a lifting force to the piston 130 to perform a function as a gas bearing with respect to the piston 130.

The compressor body 100 may further include a motor 140. The motor 140 may include an outer stator 141 fixed to the frame 110 and disposed or provided to surround the cylinder 120, an inner stator 148 disposed or provided to be spaced inward from the outer stator 141, and a permanent magnet 146 disposed or provided in a space between the outer stator 141 and the inner stator 148.

The permanent magnet 146 may be linearly reciprocated by a mutual electromagnetic force between the outer stator 141 and the inner stator 148. Also, the permanent magnet 146 may be provided as a single magnet having one polarity or by coupling a plurality of magnets having three polarities to each other.

The permanent magnet 146 may be installed or provided on a magnet frame 138. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange 132 to extend in an outer radial direction and then be bent forward. The permanent magnet 146 may be installed or provided on a front end of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations may be laminated in a circumferential direction. The plurality of core blocks may be disposed or provided to surround at least a portion of the coil winding bodies 141*b* and 141*c*.

A stator cover 149 may be disposed or provided on or at one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

The inner stator 148 may be fixed to an outer circumference of the frame 110. Also, in the inner stator 148, the plurality of laminations may be laminated in the circumferential direction outside of the frame 110.

The compressor body 100 may further include a support 137 that supports the piston 130. The support 137 may be coupled to a rear portion of the piston 130, and the muffler 400 may be disposed or provided to pass through an inside of the support 137. The piston flange 132, the magnet frame 138, and the support 137 may be coupled to each other using a coupling member.

A balance weight 179 may be coupled to the support 137. A weight of the balance weight 179 may be determined based on a drive frequency range of the compressor body 100.

According to this embodiment, a friction between the piston and the cylinder is prevented using a gas bearing structure, a drive frequency may be increased while reducing a size of the motor, thereby reducing a size of the whole compressor.

The compressor body 100 may further include a back cover 170 coupled to the stator cover 149 and extending rearward. The back cover 170 may include three support legs; however, embodiments are not limited thereto. The three support legs may be coupled to a rear surface of the stator cover 149. A spacer 181 may be disposed or provided between the three support legs and a rear surface of the stator cover 149. A distance from the stator cover 149 to a rear end of the back cover 170 may be determined by adjusting a thickness of the spacer 181. Also, the back cover 170 may be spring-supported by the support 137.

The compressor body 100 may further include an inflow guide part or guide 500 coupled to the back cover 170 to guide inflow of the refrigerant into the muffler 400. At least a portion of the inflow guide part 500 may be inserted into the suction muffler 400.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 which reciprocates within the linear compressor 10 may be stably moved by an action of the plurality of resonant springs 176*a* and 176*b* to reduce vibration or noise due to movement of the piston.

The compressor body 100 may further include a plurality of sealing members or seals 127 and 128 that increases a coupling force between the frame 110 and peripheral parts or components around the frame 110. The plurality of sealing members 127 and 128 may include a first sealing member or seal 127 disposed or provided at a portion at which the frame 110 and the discharge cover 160 are coupled to each other. The plurality of sealing members 127 and 128 may further include a second sealing member or seal 128 disposed or provided at a portion at which the frame 110 and the discharge cover 160 are coupled to each other. Each of the first and second sealing members 127 and 128 may have a ring shape.

The plurality of support devices 200 and 300 may include a first support device or support 200 coupled to one or a first side of the compressor body 100, and a second support device or support 300 coupled to the other or a second side of the compressor body 100. As an axial vibration and a radial vibration of the compressor body 100 may be absorbed by the plurality of support devices 200 and 300, it is possible to prevent the compressor body 100 from directly colliding with the shell 101 or the shell covers 102 and 103.

Although not limited thereto, the first support device 200 may be fixed to the first shell cover 102, and the second support device 300 may be fixed to the fixing bracket coupled to the inner circumferential surface of the shell 101 at a position adjacent to the second shell cover. On the other hand, the process pipe 106 may be coupled to an outer circumferential surface of the shell 101. A worker may inject the refrigerant into the linear compressor 10 through the process pipe 106. The refrigerant suctioned through the process pipe 106 may be a liquid refrigerant.

When the refrigerant is injected through the process pipe 106, oil existing in a refrigerant injector and/or working oil existing in a cooling system may be injected together with the refrigerant. The process pipe 106 may be coupled to the shell 101 at a height different from a height of the discharge pipe 105 so as to avoid interference with the discharge pipe 105. The height is understood as a distance from the leg 50 in the vertical direction (or the radial direction). As the discharge pipe 105 and the process pipe 106 are coupled to the outer circumferential surface of the shell 101 at the heights different from each other, work convenience may be improved.

Figure 5:
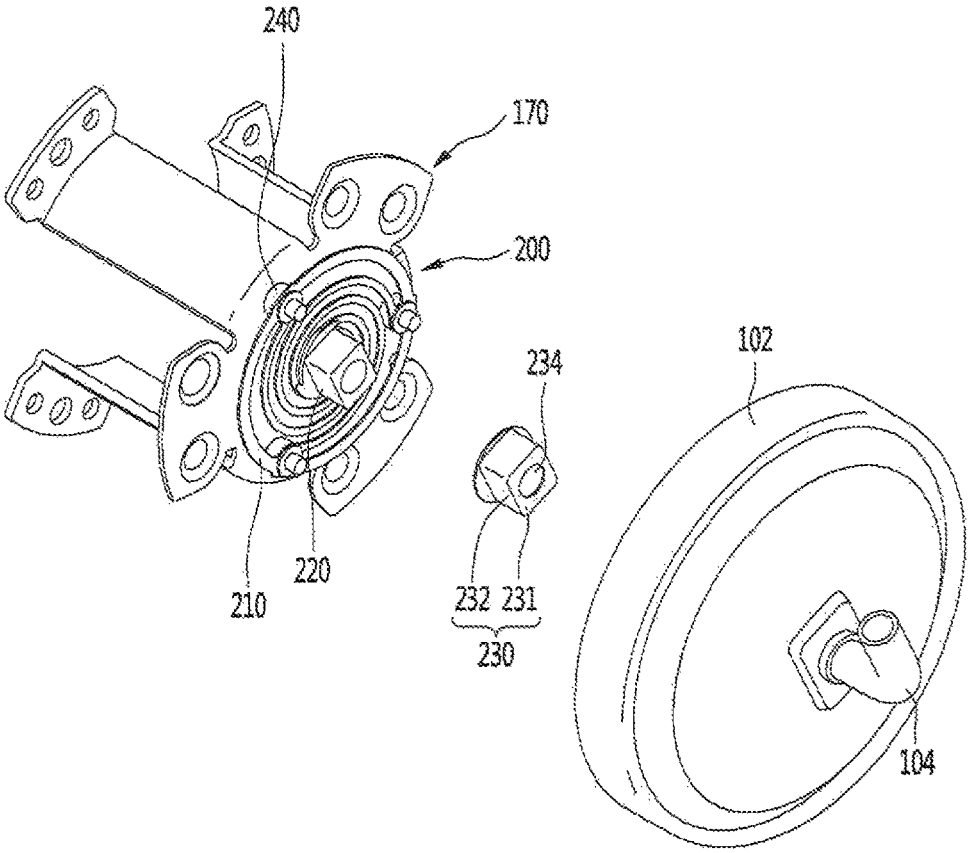
FIG. 5 is a perspective view illustrating a back cover and a first shell cover to which a first support device or support is coupled.
Figure 6:
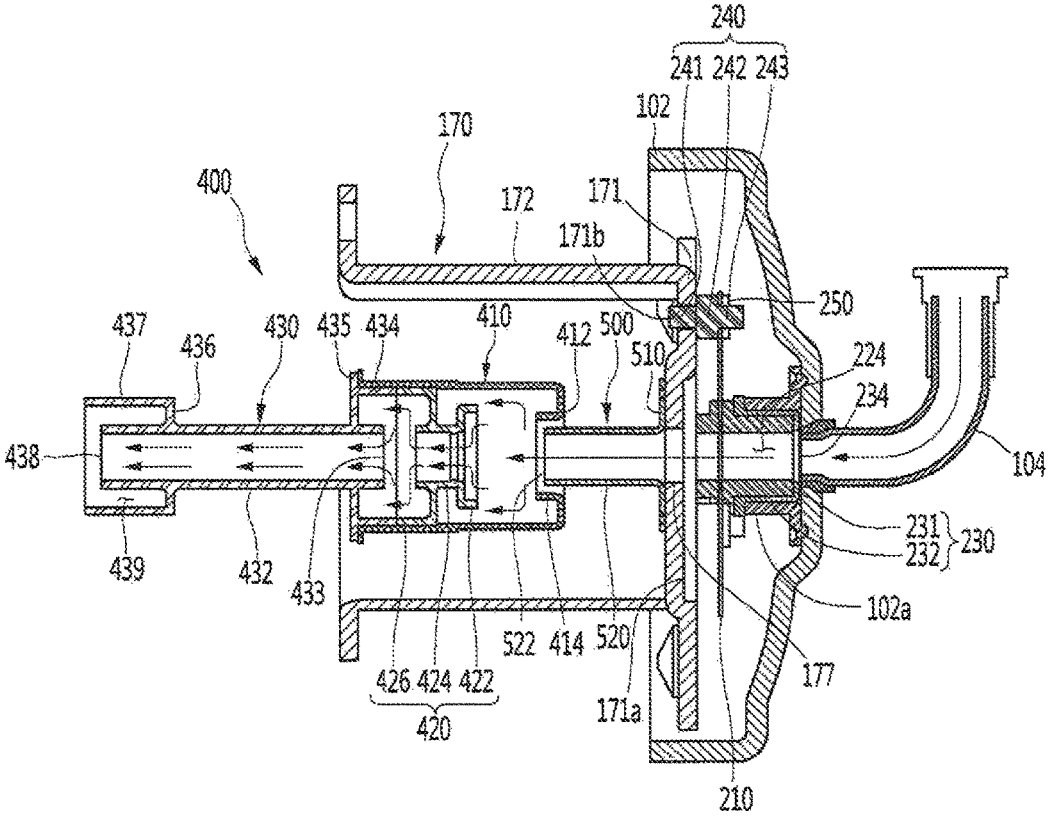
FIG. 6 is a view illustrating a configuration forming a passage for a refrigerant of a suction pipe to flow into a suction muffler.
Figure 7:
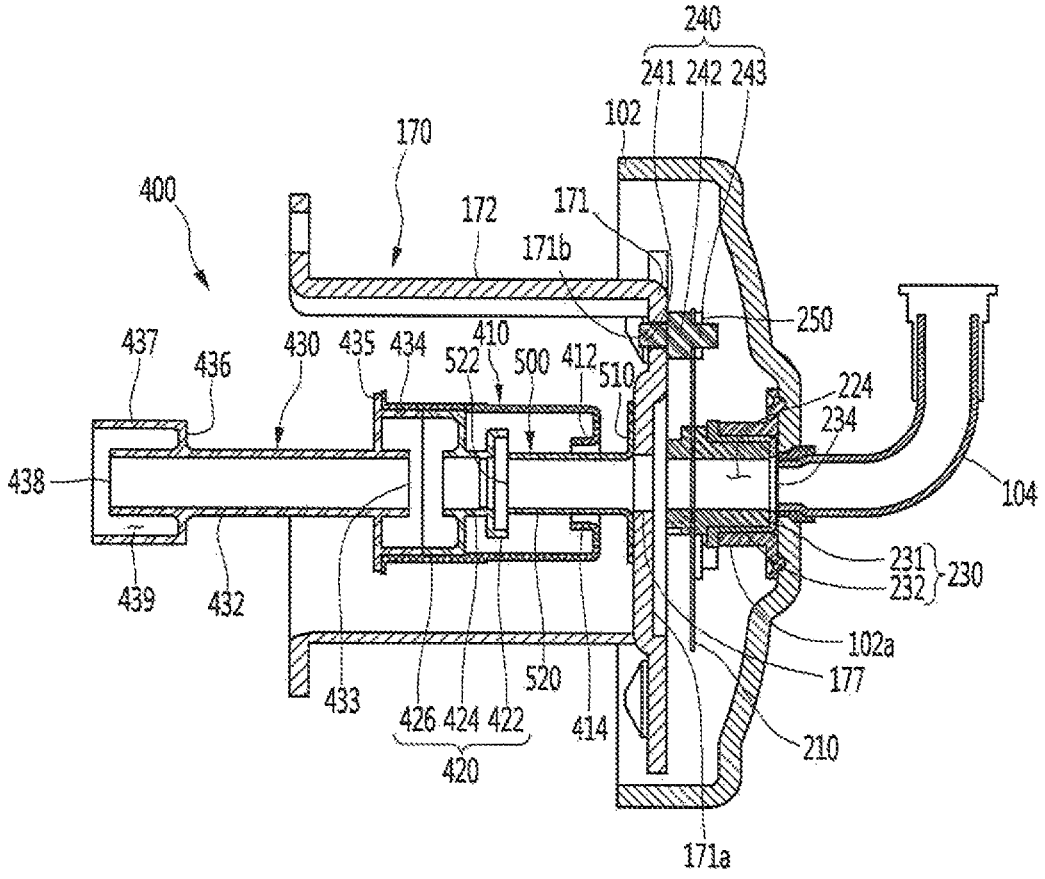
FIG. 7 is a view illustrating an arrangement relation between an inflow guide part or guide and the suction muffler when a piston is disposed at a top dead center.
Figure 8:
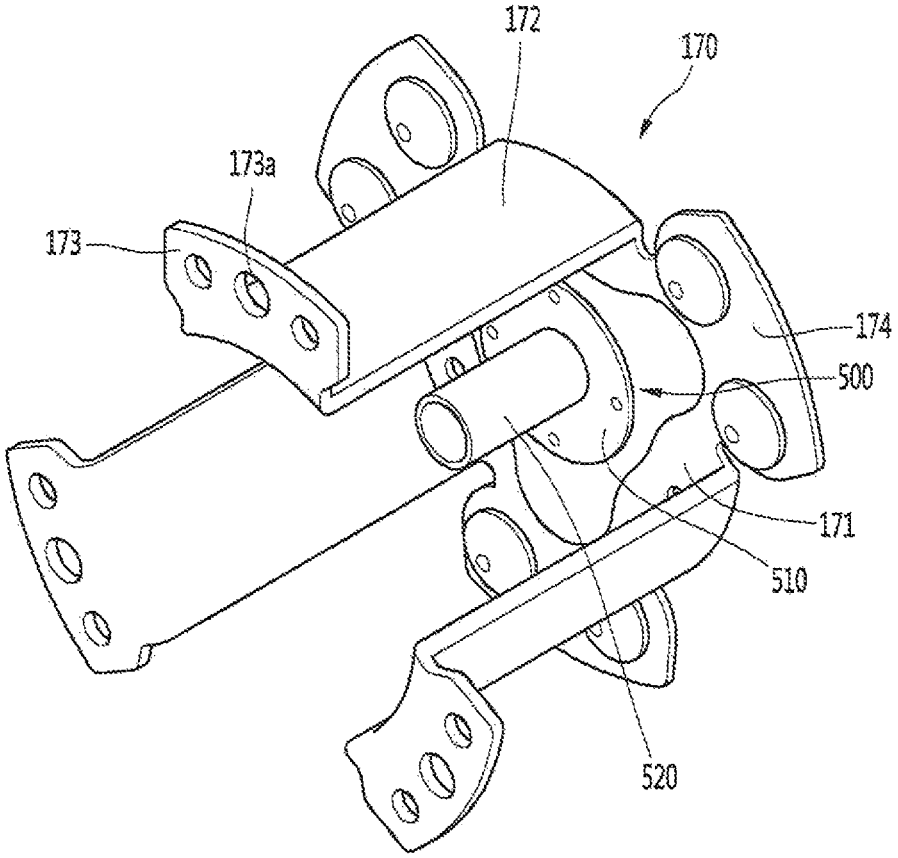
FIG. 8 is a perspective view of a back cover according to an embodiment.
Figure 9:
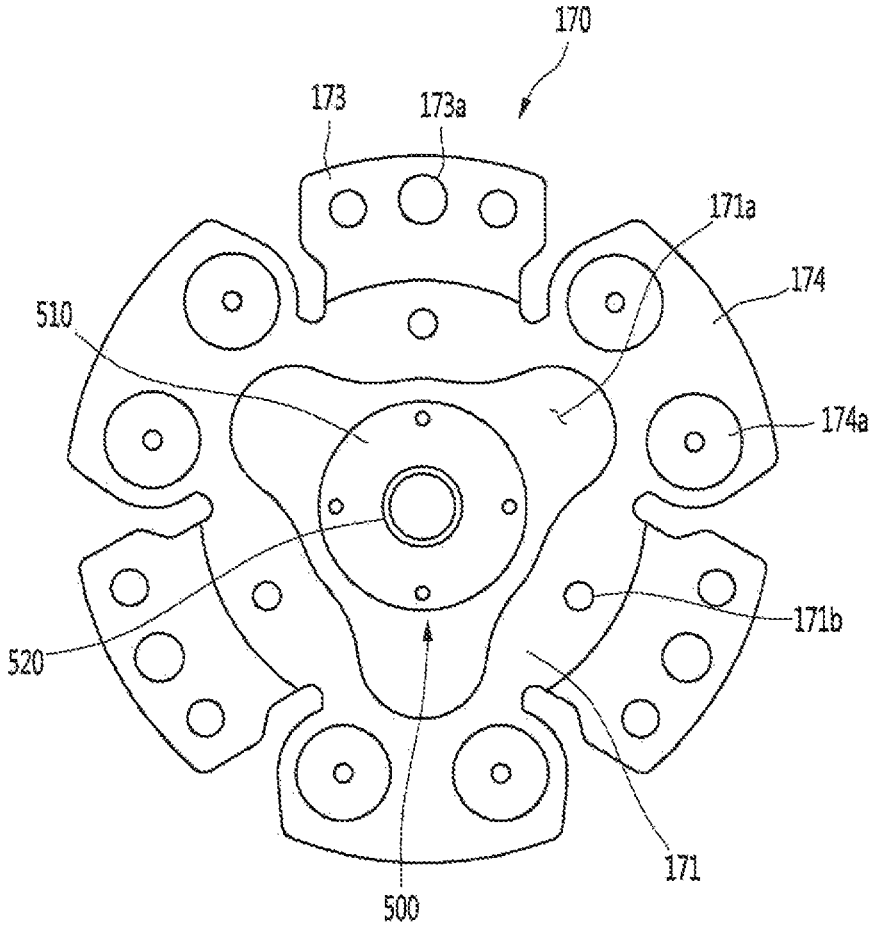
FIG. 9 is a rear view of the back cover according to an embodiment.

FIG. 5 is a perspective view illustrating a back cover and a first shell cover to which a first support device or support is coupled. FIG. 6 is a view illustrating a configuration forming a passage for a refrigerant of a suction pipe to flow into a suction muffler. FIG. 7 is a view illustrating an arrangement relation between an inflow guide part or guide and the suction muffler when a piston is disposed at a top dead center. FIG. 8 is a perspective view of the back cover according to an embodiment. FIG. 9 is a rear view of the back cover according to an embodiment.

FIG. 6 is a view illustrating an arrangement relation between the inflow guide part and the suction muffler when a piston is disposed or provided at a bottom dead center.

Referring to FIGS. 5 to 9, the back cover 170 may be fixed to the first shell cover 102 by the first support device 200. The suction pipe 104 may be coupled to the first shell cover 102, and the back cover 170 and the first support device 200 may serve to guide the refrigerant suctioned through the suction pipe 104 toward the suction muffler 400.

The first support device 200 may include the plate spring 210. The plate spring 210 may be fixed to, for example, the back cover 170. The plate spring 210 may be disposed to be erected within the shell 101, such that an axis or central longitudinal axis of the compressor body 100 passes through the center of the plate spring 210.

The first support device 200 may further include a spring coupling part or portion 220 coupled to the plate spring 210. The spring coupling part 220 may allow the first support device 200 to be easily coupled to the first shell cover 102.

The first shell cover 102 may include a cover support part or support 102*a* for coupling of the first support device 200. The cover support part 102*a* may be integrally formed with the first shell cover 102, or may be coupled to the first shell cover 102.

The spring coupling part 220 may be inserted into an accommodation part or portion 102*c* of the cover support part 102*a*. A buffer part or buffer 230 may be provided between the spring coupling part 220 and the cover support part 102*a*. Therefore, vibration transferred from the spring coupling part 220 may be absorbed by the buffer part 230, without being transferred to the cover support part 102*a*. The buffer part 230 may be made of a material capable of absorbing impact while being deformed by an external force and may be made of, for example, a rubber or a silicon material.

Although not limited thereto, the buffer part 230 may be fitted into the cover support part 102*a*, and the spring coupling part 220 may be fitted into the buffer part 230. A cross-section of the accommodation part 102*c* of the cover support part 102*a* and a cross-section of the buffer part 230 may be formed to have a non-circular shape such that the buffer part 230 does not relatively rotate with respect to the cover support part 102*a*. For example the cross-section of the accommodation part 102*c* of the cover support part 102*a* and the cross-section of the buffer part 230 may be formed to have a rectangular shape; however, embodiments are not limited thereto.

Also, a cross-section of a portion of the spring coupling part 220 inserted into the buffer part 230 may be formed to have a non-circular shape such that the spring coupling part 220 does not relatively rotate with respect to the buffer part 230. For example, the cross-section of the spring coupling part 220 inserted into the buffer part 230 may be formed to have a rectangular shape; however, embodiments are not limited thereto.

The buffer part 230 may include a first contact surface 231 and a second contact surface 232. The first contact surface 231 may contact the spring coupling part 220 in the axial direction so as to absorb axial vibration transferred from the first support device 200. The second contact surface 232 may contact the spring coupling part 220 in the radial direction so as to absorb radial vibration transferred from the first support device 200.

The second contact surface 232 may surround at least a portion of the spring coupling part 220. The first contact surface 231 may define an opening 234 through which the refrigerant may pass.

According to this embodiment, the first support device 200 may be coupled to the first shell cover 102, with the buffer part 230 being disposed or provided between the first support device 200 and the first shell cover 102, thereby preventing vibration generated during operation of the linear compressor 10 from being transferred to the shell 101 by the first shell cover 102.

In this embodiment, axial vibration of the compressor body 100 may be absorbed by the plate spring 210 and radial vibration may be absorbed by the buffer part 230, thereby minimizing a phenomenon that vibration of the compressor body 100 is transferred to the shell 101 by the first shell cover 102.

The spring coupling part 220 may include a refrigerant passage 224 through which the refrigerant suctioned through the suction pipe 104 may pass. For example, the refrigerant passage 224 may be aligned with the opening 234 of the buffer part 230 in a state in which the spring coupling part 220 is fitted into the buffer part 230. The spring coupling part 220 may be integrally formed with the plate spring 210 by insert injection molding, for example.

The plate spring 210 may be coupled to the back cover 170 by a back cover coupling member 240. The back cover coupling member 240 may include a cover insertion part or portion 241 that passes through a coupling hole 171*b* of the back cover 170, a contact part or contact 242 that contacts the back cover 170, and a spring insertion part or portion 243 that passes through the first plate spring 210.

A diameter of the contact part 242 may be greater than a diameter of each of the cover insertion part 241 and the spring insertion part 243. Therefore, when the contact part 242 contacts the back cover 170 in a state in which the cover insertion part 241 passes through the coupling hole 171*b* of the back cover 170, the plate spring 210 and the back cover 170 may be spaced a predetermined distance from each other.

In a state in which the spring insertion part 233 passes through the plate spring 210, a washer 250 may be coupled to the spring insertion part 243 so as to prevent the plate spring 210 from being released from the back cover coupling member 240.

The back cover 170 may include a cover body 171 that defines the coupling hole 171*b*, and a plurality of coupling legs 172 that extends from the cover body 171 toward the motor 140. Each of the coupling legs 172 may include a coupling part or portion 173 that couples to the stator cover 149. The coupling part 173 extends from the coupling leg 172 in the radial direction of the compressor body 100.

The coupling part 173 may define a coupling hole 173*a* to which a coupling member S may be coupled. The coupling member S may pass through the coupling hole 173*a* of the coupling part 173 and be coupled to the stator cover 149.

A recess part or recess 171*a* may be formed in the cover body 171. The recess part 171*a* may be recessed from the cover body 171 toward the piston 130. As illustrated in FIG. 6, the spring coupling part 220 may be spaced apart from the recess part 171*a* when the compressor body 100 is not operated by the recess part 171*a*.

When the compressor body 100 moves toward the spring coupling part 220 (a rightward direction in FIG. 6) due to axial vibration of the compressor body 100, if the recess part 171*a* contacts the spring coupling part 220, the compressor body 100 does not move in a rightward direction any more. Therefore, a moving distance in the axial direction of the compressor body 100 is reduced, thereby preventing the plate spring 210 from being excessively deformed.

The recess part 171*a* may be formed in the cover body 171 so as to limit the axial movement of the compressor body 100 while preventing an increase in length in the axial direction of the linear compressor 10. When the state in which the spring coupling part 220 contacts the recess part 171*a* is maintained, there is a problem that noise is great due to friction between the recess part 171*a* and the spring coupling part 220 during vibration of the compressor body 100, and there is a problem that the compressor body 100 does not stably perform a resonant motion. Therefore, the spring coupling part 220 may maintain a state of being spaced apart from the recess part 171*a* when the compressor body 100 is mot operated by the recess part 171*a*.

The recess part 171*a* may define a refrigerant opening 177 through which the refrigerant flowing along the refrigerant passage 224 of the spring coupling part 220 passes. Further, the recess part 171*a* may be formed to have an approximately triangular shape as shown in FIG. 9. The recess part 171*a* may serve to improve a strength of the cover body 171, and a portion of the recess part 171*a* may be disposed or provided between two adjacent back cover coupling holes 171*b* so as to maximize strength improvement.

The back cover 170 may further include a plurality of spring support parts or supports 174. The plurality of coupling legs 172 and the plurality of spring support parts 174 may be alternately arranged. The second resonant spring 176*b* may be supported to or by each of the plurality of spring support parts 174. A coupling protrusion 174*a* to be coupled to the second resonant spring 176*b* may be provided in or for each of the plurality of spring support parts 174.

The inflow guide part 500 may be fixed to the back cover 170. The inflow guide part 500 may include a guide pipe 520 that guides the flow of the refrigerant, and a flange part or flange 510 that extends from one or a first end of the guide pipe 520 in the radial direction.

The flange part 510 may be fixed to the cover body 171. The flange part 510 may be fixed to the cover body 171 by, for example, fusion or welding.

The flange part 510 may be fixed to the cover body 171 so as to come into surface contact with the cover body 171 in the axial direction of the compressor body 100. As the flange part 510 may be fixed to the cover body 171, a coupling force between the inflow guide part 500 and the back cover 170 may be improved. Also, it is possible to prevent the inflow guide part 500 from being separated from the back cover 170 during vibration of the compressor body 100.

The flange part 510 may be fixed to the cover body 171 in a state in which a center of the guide pipe 520 and a center of the refrigerant opening 177 of the cover body 171 are aligned so as to be coaxial.

The guide pipe 520 may maintain a state of being inserted into the suction muffler 150 when operation of the compressor body 100 is stopped. At this time, as the guide pipe 520 extends from the recess part 171, a length of the guide pipe 520 may be reduced. If the length of the guide pipe 520 is reduced, a weight of the inflow guide part 500 may be reduced and thus a total weight of the compressor itself may be reduced. The length of the coupling leg may be formed to be greater than the length of the guide pipe 520, such that the guide pipe 520 does not interfere with the suction muffler 400 within the suction muffler 400 and the coupling leg 172 is coupled to the stator cover 149.

As described above, the suction muffler 400 may include first to third mufflers 410, 420, and 430. The first muffler 410 may have an approximately cylindrical shape. The first muffler 410 may define an opening 412 through which the guide pipe 520 may pass. A refrigerant outlet 522 of the guide pipe 520 may pass through the opening 412 and be inserted into the first muffler 410. A diameter of the opening 412 through which the guide pipe 520 may pass may be greater than an external diameter of the guide pipe 520.

The first muffler 410 may further include a blocking sleeve 414 that blocks the refrigerant introduced into the first muffler 410 from being discharged to the outside through the opening 412. That is, the blocking sleeve 414 blocks the refrigerant in the first muffler 410 from flowing into the opening 412.

The blocking sleeve 414 may extend, for example, from an edge of the opening 412 toward the second muffler 420. The blocking sleeve 414 may have, for example, a cylindrical shape.

Therefore, the guide pipe 520 may be disposed or provided inside of the blocking sleeve 414. An internal diameter of the blocking sleeve 414 may be formed to be greater than an external diameter of the guide pipe 520, such that the blocking sleeve 414 and the guide pipe 520 are spaced apart from each other.

The blocking sleeve 414 and the guide pipe 520 may be spaced apart from each other, so as to reduce noise generated by friction between the blocking sleeve 414 and the guide pipe 520 during vibration of the compressor body 100. If the compressor body 100 is operated in a state in which the blocking sleeve 414 and the guide pipe 520 are in a contacted state, there is a problem that the noise caused by the friction between the blocking sleeve 414 and the guide pipe 520 increases. Also, during radial vibration of the compressor body 110, the guide pipe 520 may be deformed or the inflow guide part 520 may be separated from the back cover 170. Therefore, according to embodiments disclosed herein, the blocking sleeve 414 may be separated from the guide pipe 520.

According to this embodiment, gas supplied into the cylinder 120 through the cylinder nozzle (see reference numeral 125 of FIG. 4) to act as the gas bearing may be discharged toward a rear side of the cylinder 120 (a rightward direction in FIG. 4). The gas supplied into the cylinder 120 is a high-temperature gas. If the high-temperature gas is introduced into the suction muffler 150, suction loss occurs, and thus, power consumption of the linear compressor 10 increases.

According to embodiments disclosed herein, as the guide pipe 520 of the inflow guide part 500 fixed to the back cover 170 may be disposed or provided inside of the first muffler 410 through the opening 412 of the first muffler 410, it is possible to minimize a phenomenon that the high-temperature gas discharged from the cylinder 120 to the shell 101 is introduced into the opening 412 of the first muffler 410. That is, as the high-temperature gas acts as a resistor in the opening 412 of the first muffler 410, the guide pipe 520 may minimize introduction of the gas.

Further, as the blocking sleeve 414 is formed to have a cylindrical shape with a certain length and the guide pipe 520 may be disposed or provided in an inner space of the blocking sleeve 414, it is possible to further prevent the high-temperature gas from passing between the blocking sleeve 414 and the guide pipe 520. Furthermore, as the blocking sleeve 414 has a cylindrical shape to surround the guide pipe 520, the guide pipe 520 and the blocking sleeve 414 come into surface contact with each other when the guide pipe 520 and the blocking sleeve 414 contact each other due to radial vibration of the compressor body 100. Therefore, the blocking sleeve 414 and the guide pipe 520 may be rapidly aligned in the horizontal direction.

According to embodiments disclosed herein, the piston 130 may reciprocate between a bottom dead center and a top dead center as shown in FIGS. 6 and 7. When the piston 130 reciprocates between the bottom dead center and the top dead center, it is possible to maintain the state in which the guide pipe 510 and the blocking sleeve 414 overlap each other in the radial direction. That is, when the piston 130 is positioned at the bottom dead center and when the piston 130 is positioned at the top dead center, it is possible to maintain the state in which the guide pipe 510 and the blocking sleeve 414 overlap each other in the radial direction.

Even when the piston 130 moves from the top dead center (FIG. 7) to the bottom dead center (FIG. 6), the length of the guide pipe 520 inserted into the first muffler 410 increases. In order to prevent the guide pipe 520 from interfering with the second muffler 420, a front end of the guide pipe 520 may be spaced apart from a rear end of the second muffler 420 in a state in which the piston 130 is positioned at the bottom dead center.

The second muffler 420 may be accommodated in the first muffler 410. The second muffler 420 may be accommodated in the first muffler 410 at an opposite side of the opening 412 of the first muffler 410.

The second muffler 420 may include first flow part or portion 422 for introduction of the refrigerant introduced in the first muffler 410, a second flow part or portion 424 that extends from the first flow part 422 toward the piston 130, and a first contact part or contact 426 that extends outward from the first flow part 424 and contacts an inner circumferential surface of the first muffler 410.

An internal diameter of a portion of the first muffler 410 may be equal to an external diameter of the first contact part 426 of the second muffler 420. An internal diameter of another portion of the first muffler 410 may be less than the external diameter of the first contact part 426 of the second muffler 420 so as to restrict an insertion depth of the second muffler 420.

An inlet diameter of the first flow part 422 may be formed to be less than an internal diameter of the first muffler 410. An inlet diameter of the first flow part 422 may be formed to be greater than an internal diameter of the blocking sleeve 414.

Therefore, a flow cross-sectional area increases in a process in which the refrigerant discharged from the guide pipe 520 flows from the space inside of the first muffler 410 to the first flow part 422. Consequently, a flow velocity may be reduced, and thus, noise may be reduced.

The third muffler 430 may be inserted into the first muffler 410 at an opposite side of the opening 412 of the first muffler 410 in a state in which the second muffler 420 is inserted into the first muffler 410. The third muffler 430 may include a refrigerant flow pipe 432 through which the refrigerant flowing through the second muffler 420 may be introduced, a flange 435 that extends from the refrigerant flow pipe 432, and a second contact part or contact 434 that extends from the flange 435 and contacts an inner surface of the first muffler 410.

An external diameter of the flange 435 may be greater than an external diameter of the second contact part 434. The external diameter of the flange 435 may be greater than the internal diameter of the first muffler 410. Therefore, as the flange 435 contacts the outer surface of the first muffler 410 when the second contact part 434 is inserted into the first muffler 410, it is possible to restrict an insertion depth of the second contact part 434.

A diameter of the opening 433 of the refrigerant flow pipe 432 may be less than an internal diameter of the first contact part 426 and the second contact part 434. The refrigerant flow pipe 432 may be spaced apart from the second flow part 424 of the second muffler 420.

Therefore a flow cross-sectional area may increase in a process in which the refrigerant discharged from the second flow part 424 of the second muffler 420 flows to the refrigerant flow pipe 432. Consequently, a flow velocity may be reduced, and thus, noise may be reduced.

The third muffler 430 may include a first extension part or extension 436 that extends from an outer circumferential surface of the refrigerant flow pipe 432 in the radial direction, and a second extension part or extension 437 that extends in a direction away from the first extension part 436 to the second muffler 420. The first extension part 436 and the second extension part 437 may define a storage space 439 to store at least a portion of the refrigerant suctioned into the compression space P.

At least a portion of the refrigerant discharged from the outlet 438 of the refrigerant flow pipe 432 may flow backward toward the flange 435 of the third muffler 430 through a space between the piston 130 and the refrigerant flow pipe 432, or may form swirl in a space around the outlet 438 of the refrigerant flow pipe 432. In particular, as an amount of refrigerant suctioned into the compression space P increases, such flow occurs more frequently. A backward flow or swirl of the refrigerant may deteriorate a refrigerant suction efficiency.

As the storage space 439 stores portion of the refrigerant discharged from the refrigerant flow pipe 432, it is possible to perform a function of preventing the backward flow or swirl of the refrigerant at a front end (outlet end portion) of the refrigerant flow pipe 432. Also, the refrigerant stored in the storage space 439 may experience a compression and discharge process after the suction of the refrigerant is completed, and then be suctioned into the compression space P in the next refrigerant suction process.

The first extension part 436 may be disposed or provided at a position which is closer to the suction hole (see reference numeral 133 of FIG. 3) of the piston 130 rather than the outlet 438 of the refrigerant flowpipe 432. Therefore, an area of the storage space 439 may increase, and thus, a larger amount of refrigerant may be stored.

As described above, the flow of the refrigerant may be controlled by forming the storage space 439 at a position which is adjacent to the outlet 439 of the refrigerant flow pipe 432, thereby improving the refrigerant suction efficiency.

According to embodiments disclosed herein, as friction between the piston and the cylinder is prevented using the gas bearing structure, a drive frequency may be increased while reducing a size of a motor, thereby reducing a size of a whole compressor. Further, as the inflow guide part is provided in the back cover and is positioned inside the suction muffler, the high-pressure gas used as the gas bearing may be introduced into the suction muffler, thereby minimizing deterioration of a suction efficiency. Furthermore, due to the blocking sleeve, the gas introduced into the suction muffler may be prevented from flowing backward to the outside of the suction muffler.

Also, as the inflow guide part may be coupled to the recess part of the cover body constituting the back cover, a length of the inflow guide part may be reduced. Additionally, the inflow guide part may include the guide pipe and the flange, and the flange may be coupled to the cover body of the back cover, thereby improving a coupling force between the inflow guide part and the back cover.

Embodiments disclosed herein provide a linear compressor in which a gas bearing may be applied between a cylinder and a piston thereby reducing a frictional force generated by oil and reducing a volume thereof. Embodiments disclosed herein also provide a linear compressor capable of preventing a refrigerant gas used as a gas bearing from being introduced again into a cylinder.

Embodiments disclosed herein provide a linear compressor that may include a casing; a frame accommodated in the casing; a cylinder passing through a center of the frame, supported by the frame, and defining a compression space for a refrigerant; a piston inserted into the cylinder to reciprocate in an axial direction of the cylinder and having one or a first end that compresses the refrigerant supplied to the compression space; a suction muffler which may be coupled to the other or a second end of the piston and through which the refrigerant supplied to the compression space may flow; a spring unit or spring that allows a resonant motion of the piston; a back cover including a cover body that defines a refrigerant opening at a central portion, such that a refrigerant may pass therethrough, the back cover supporting the spring unit; and an inflow guide part or guide which may be fixed to the cover body and guide the refrigerant passing through the refrigerant opening towards an inside of the suction muffler. At least a portion of the inflow guide part may be inserted into the suction muffler, and a central axis thereof may be aligned with a central axis of the refrigerant opening. The inflow guide part may include a guide pipe that extends a certain or predetermined length so as to be inserted into the suction muffler, and a flange part or flange bent at a rear end of the guide pipe and coming into surface contact with the cover body.

The linear compressor may further include a support device or support that supports the back cover and fixes the back cover to the casing. A recess part or recess which is recessed towards the piston may be formed at an inner side of the cover body. The flange part may be coupled to the recess part.

The support device may include a plate spring fixed to an opposite side of the inflow guide part in the cover body, and a spring coupling part or portion coupled to a center of the plate spring. A refrigerant passage may be defined inside of the spring coupling part.

The spring coupling part may be maintained in a state of being spaced apart from the recess part. When the back cover vibrates toward the spring coupling part, the spring coupling part may contact the recess part due to deformation of the plate spring.

A center of the guide pipe, a center of the refrigerant opening, and a center of the refrigerant passage may be aligned on a same line.

The linear compressor may further include a motor that provides power to the piston, and a stator cover that supports the motor together with the frame. The back cover may include a plurality of spring support parts or supports that extends from an edge of the cover body in a radial direction and supports the spring unit, and a plurality of coupling legs bent at an edge of the cover body and extending with a certain or predetermined length toward the stator cover. The coupling leg may extend to be longer than the guide pipe.

The suction muffler may include an opening through which the guide pipe may pass, and a blocking sleeve that extends from an edge of the opening toward the piston. An internal diameter of the blocking sleeve may be greater than an external diameter of the guide pipe.

The suction muffler may include a first muffler in which the opening and the blocking sleeve may be formed at one or a first end thereof, and a second muffler accommodated into the first muffler and including a flow part or portion through which the refrigerant passing through the guide pipe may flow. An inlet diameter of the flow part may be greater than an internal diameter of the blocking sleeve.

The linear compressor may further include a third muffler having one or a first end inserted into the other or a second end of the first muffler and coupled to the second muffler. The other or a second end of the third muffler may be accommodated into the piston.

The third muffler may include a refrigerant flowing pipe through which the refrigerant may flow; a first extension part or extension that extends from an outer circumferential surface of the refrigerant flowing pipe in a radial direction; and a second extension part or extension bent at the first extension part and extending in a direction far away from the second muffler. An end of the second extension part may be disposed to be more front than an outlet of the refrigerant flowing pipe.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structures or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:
a casing;
a frame accommodated in the casing;
a cylinder that passes through a center of the frame, is supported by the frame, and defines a compression space for a refrigerant;
a piston inserted into the cylinder to reciprocate in an axial direction of the cylinder and having a first end that compresses the refrigerant supplied to the compression space;
a motor that provides power to the piston;
a stator cover that supports the motor together with the frame;
a suction muffler coupled to a second end of the piston and through which the refrigerant supplied to the compression space flows;
a plurality of resonant springs that allows a resonant motion of the piston;
a back cover that supports the plurality of resonant springs, the back cover including:
a cover body that defines a refrigerant opening at a central portion, such that the refrigerant introduced into the casing passes therethrough;
a plurality of spring supports that extends from an edge of the cover body in a radial direction and respectively supports the plurality of resonant springs; and
a plurality of coupling legs which is bent at respective points of an edge of the cover body and extends a predetermined length to be fixed to the stator cover; and
an inflow guide which is fixed to the back cover and guides the refrigerant passing through the refrigerant opening of the cover body towards an inside of the suction muffler, the inflow guide including:
a flange fixed to the cover body; and
a guide pipe that extends a predetermined length from a center of the flange, such that an end of the guide pipe is inserted into the suction muffler, wherein the suction muffler includes:
an opening through which the guide pipe passes; and
a blocking sleeve that extends a predetermined length from an edge of the opening in a direction in which the guide pipe extends, and wherein a central longitudinal axis of the inflow guide is aligned with a central longitudinal axis of the blocking sleeve; and
a support that supports the back cover and fixes the back cover to the casing, the support including:
a plate spring fixed to the cover body at a side opposite to the inflow wide; and
a spring coupling portion coupled to a center of the plate spring, wherein a refrigerant passage is defined inside of the spring coupling portion, wherein a recess which is recessed towards the piston is formed at an inner side of the cover body, wherein the flange is coupled to the back cover at a surface opposite to the recess, wherein the springy coupling portion is maintained in a state of being spaced apart from the recess, and wherein, when the back cover vibrates toward the spring coupling portion, the spring coupling portion contacts the recess due to deformation of the plate spring.

2. The linear compressor according to claim 1, wherein a center of the guide pipe, a center of the refrigerant opening, and a center of the refrigerant passage are aligned on a same line.

3. The linear compressor according to claim 1, wherein an internal diameter of the blocking sleeve is greater than an external diameter of the guide pipe.

4. The linear compressor according to claim 1, wherein the suction muffler includes:
a first muffler in which the opening and the blocking sleeve are formed at a first end thereof; and
a second muffler accommodated into the first muffler and including a flow portion through which the refrigerant passing through the guide pipe flows, and wherein an inlet diameter of the flow portion is greater than an internal diameter of the blocking sleeve.

5. The linear compressor according to claim 4, further including a third muffler having a first end inserted into a second end of the first muffler and coupled to the second muffler, wherein a second end of the third muffler is accommodated in the piston.

6. The linear compressor according to claim 5, wherein the third muffler includes:
a refrigerant flow pipe through which the refrigerant flows;
a first extension that extends from an outer circumferential surface of the refrigerant flow pipe in a radial direction; and
a second extension bent from the first extension and extending in a direction away from the second muffler, and wherein an end of the second extension is disposed to be spaced away from an outlet of the refrigerant flow pipe in a direction in which the refrigerant flows in the refrigerant flow pipe.

7. The linear compressor according to claim 1, wherein the casing includes:
a shell having a substantially cylindrical shape accommodating the frame and having both ends open; and
a first shell cover and a second shell cover coupled to the respective ends of the shell.

8. The linear compressor according to claim 7, further including a suction pipe coupled to the first shell cover, wherein the refrigerant is suctioned into the inflow guide through the suction pipe.

9. The linear compressor according to claim 8, wherein the first shell cover includes a cover support coupled to the support, wherein the cover support includes an accommodation portion in which the spring coupling portion of the support is inserted.

10. The linear compressor according to claim 9, wherein a buffer is provided between the spring coupling portion and the cover support to absorb vibrations transferred from the spring coupling portion.

11. The linear compressor according to claim 10, wherein the buffer includes a first contact surface that contacts the spring coupling portion in an axial direction of the spring coupling portion to absorb axial vibrations transferred from the support, and a second contact surface that contacts and surrounds a portion of the spring coupling portion in a radial direction of the spring coupling portion to absorb radial vibrations transferred from the support.

12. The linear compressor according to claim 11, wherein the first contact surface of the buffer defines an opening through which the refrigerant passes.

13. The linear compressor according to claim 10, wherein the buffer is fitted into the accommodation portion of the cover support, and the spring coupling portion is fitted into the buffer.

14. The linear compressor according to claim 13, wherein a cross section of the accommodation portion of the cover support and a cross section of the buffer are formed to have a non-circular shape, such that the buffer does not relatively rotate with respect to the cover support, and wherein a cross section of a portion of the spring coupling portion inserted into the buffer is formed to have a non-circular shape, such that the spring coupling portion does not relatively rotate with respect to the buffer.

15. The linear compressor according to claim 14, wherein the cross section of the accommodation portion of the cover support, the cross section of the buffer, and the cross section of the portion of the spring coupling portion inserted into the buffer are formed to have a rectangular shape.

16. The linear compressor according to claim 10, wherein the buffer is made of a rubber material or a silicon material.

* * * * *